US006260638B1

(12) United States Patent
Massa et al.

(10) Patent No.: US 6,260,638 B1
(45) Date of Patent: Jul. 17, 2001

(54) ROTATABLE CUTTING BIT ASSEMBLY WITH WEDGE-LOCK RETENTION ASSEMBLY

(75) Inventors: Ted R. Massa, Latrobe; Robert H. Montgomery, Jr., Everett; David R. Siddle, Greensburg; William P. Losch, Bedford, all of PA (US)

(73) Assignee: Kennametal PC Inc., Monrovia, CA (US)

( * ) Notice: Subject to any disclaimer, the term of this patent is extended or adjusted under 35 U.S.C. 154(b) by 0 days.

(21) Appl. No.: 09/376,725

(22) Filed: Aug. 17, 1999

Related U.S. Application Data

(62) Division of application No. 08/893,031, filed on Jul. 15, 1997, now Pat. No. 5,996,714.

(51) Int. Cl.[7] ..... E21B 10/62

(52) U.S. Cl. ..... 175/427; 175/420.1

(58) Field of Search ..... 175/427, 426, 175/420.1, 415, 417, 418, 413, 421, 435; 407/41

(56) References Cited

U.S. PATENT DOCUMENTS

| | | | | |
|---|---|---|---|---|
| 882,128 | | 3/1908 | Thomas . | |
| 1,089,527 | | 3/1914 | Bolton | 407/41 |
| 1,318,958 | | 10/1919 | Bernay . | |
| 1,819,303 | * | 8/1931 | Reed et al. | 175/392 |
| 1,978,084 | * | 10/1934 | Howard | 175/413 |
| 2,229,112 | | 1/1941 | Miller et al. | 407/41 |
| 2,306,798 | | 12/1942 | Benninghoff | 407/41 |
| 2,382,510 | | 8/1945 | Seiter | 408/186 |
| 2,575,239 | | 11/1951 | Stephens | 255/61 |
| 2,575,438 | | 11/1951 | Alexander et al. | 175/418 |
| 2,628,821 | | 2/1953 | Alexander et al. | 175/418 |
| 2,751,663 | | 6/1956 | Leuzinger | 407/41 |
| 2,814,854 | | 12/1957 | Murray | 407/41 |
| 2,902,260 | | 9/1959 | Tilden . | |
| 3,052,310 | * | 9/1962 | Kinzbach | 175/426 |
| 3,140,749 | | 7/1964 | Dionisotti | 175/410 |
| 3,163,246 | | 12/1964 | Vagins et al. | 175/410 |
| 3,434,553 | | 3/1969 | Weller | 175/410 |
| 3,434,554 | | 3/1969 | Bower, Jr. | 175/410 |
| 3,535,759 | | 10/1970 | Mueller | 407/41 |
| 3,765,496 | | 10/1973 | Flores et al. | 175/383 |

(List continued on next page.)

FOREIGN PATENT DOCUMENTS

| | | |
|---|---|---|
| 669636 | 4/1952 | (GB) . |
| 646045 | 5/1979 | (SU) . |
| 9530066 | 11/1995 | (WO) . |

OTHER PUBLICATIONS

Fairhurst, C., The Design of Rotary Drilling Bits, pp. 271–275.

Brochure entitled Mining Tools by KOPEX (date unknown).

Kennametal Mining Products Catalog A96–55 (15) H6, Kennametal Inc. Latrobe PA 15650, 36 pages (1996).

(List continued on next page.)

*Primary Examiner*—Hoang Dang
(74) *Attorney, Agent, or Firm*—John J. Prizzi; Kevin P. Weldon

(57) ABSTRACT

A cutting bit has a bit body which has a forward end and a rearward end. The bit body contains a seat at the forward end thereof. The bit body contains a bore intersecting the seat wherein a bore wall defines the bore. A cutting insert is received by the seat wherein the cutting insert presents a side surface facing the bore. A wedge has a generally longitudinal seating surface. The wedge has a support surface opposite to the longitudinal seating surface. The wedge is received within the bore so that the longitudinal seating surface of the wedge contacts the side surface of the cutting insert and for at least a portion of the length of the wedge the entire support surface contacts the bore wall so as to frictionally retain the cutting insert in the seat.

8 Claims, 11 Drawing Sheets

U.S. PATENT DOCUMENTS

| | | | | |
|---|---|---|---|---|
| 3,807,515 | | 4/1974 | Evans | 175/413 |
| 3,878,905 | | 4/1975 | Schaumann | 175/383 |
| 4,115,024 | * | 9/1978 | Sussmuth | 407/114 |
| 4,340,327 | | 7/1982 | Martins | 408/59 |
| 4,355,932 | | 10/1982 | Koppelmann et al. | 408/188 |
| 4,356,873 | * | 11/1982 | Dziak | 175/420.1 |
| 4,433,739 | | 2/1984 | Sarin | 175/410 |
| 4,487,532 | | 12/1984 | Hamilton | 407/37 |
| 4,492,278 | | 1/1985 | Leighton | 175/410 |
| 4,527,931 | | 7/1985 | Sarin | 407/113 |
| 4,575,287 | | 3/1986 | Oshnock et al. | 407/41 |
| 4,603,751 | | 8/1986 | Erickson | 175/410 |
| 4,633,959 | * | 1/1987 | Knox | 175/418 |
| 4,711,312 | | 12/1987 | Leibee et al. | 175/393 |
| 4,819,748 | | 4/1989 | Truscott | 175/410 |
| 4,838,366 | * | 6/1989 | Jones | 175/426 |
| 4,844,669 | | 7/1989 | Tsujimura et al. | 408/188 |
| 4,984,944 | * | 1/1991 | Pennington, Jr. et al. | 408/223 |
| 5,137,398 | | 8/1992 | Omori et al. | 408/145 |
| 5,180,022 | | 1/1993 | Brady | 175/430 |
| 5,184,689 | | 2/1993 | Sheirer et al. | 175/420.1 |
| 5,220,967 | | 6/1993 | Monyak | 175/420.1 |
| 5,287,937 | | 2/1994 | Sollami et al. | 175/427 |
| 5,303,787 | | 4/1994 | Brady | 175/430 |
| 5,467,837 | | 11/1995 | Miller et al. | 175/420.1 |
| 5,535,839 | | 7/1996 | Brady | 175/427 |
| 5,630,478 | * | 5/1997 | Schimke | 175/420.1 |

OTHER PUBLICATIONS

International Search Report mailed Oct. 23, 1998 in counterpart PCT Patent Application No. PCT/US98/12185.

* cited by examiner

ROTATABLE CUTTING BIT ASSEMBLY WITH WEDGE-LOCK RETENTION ASSEMBLY

This application is a division of U.S. patent application Ser. No. 08/893,031, filed on Jul. 15, 1997, now U.S. Pat. No. 5,996,714.

BACKGROUND

The expansion of an underground mine (e.g. a coal mine) requires digging a tunnel which initially has an unsupported roof. To stabilize and support the roof a roof bolt must be inserted into the roof to provide support. The operator must first drill holes in the roof through the use of a rotatable cutting bit or roof drill bit. A roof bolt is then inserted into each one of the holes.

A common roof drill bit design uses a cutting insert that has been brazed into a slot at the axially forward end of the roof drill bit body. U.S. Pat. No. 5,400,861 to Sheirer discloses various roof drill bits. U.S. Pat. No. 4,603,751 Erickson also discloses various roof drill bits. Applicants hereby incorporate U.S. Pat. No. 4,603,751 and U.S. Pat. No 5,400,861 by reference herein.

While brazed-on cutting inserts have provided adequate results in the drilling of holes, there have been some drawbacks associated with the utilization of the brazed-on cutting inserts. As a result of brazing, the difference in the coefficients of thermal expansion between the steel roof drill bit body and the cemented carbide (e.g., tungsten carbide-cobalt alloy) cutting insert has caused residual stresses in the cemented carbide cutting insert. These residual stresses have been detrimental to the performance of the roof drill bit since they have lead to premature failure of the cutting insert. This has been especially true in those cases where the earth strata being drilled has resulted in high impact loading on the cutting insert.

The presence of these residual stresses also has required that the grades of cemented carbide used for the cutting insert have a high transverse rupture strength. This has been a factor which has limited the number of grades which have been suitable candidates for a cutting insert in a rotatable cutting bit such as a roof drill bit.

Some materials (e.g., ceramics, low binder content tungsten carbide, binderless tungsten carbide, diamond or hard [CVD or PVD] coated ceramics, polycrystalline diamond [PCD] composites with metallic binder (e.g., cobalt) or ceramic binder (e.g., silicon nitride), polycrystalline cubic boron nitride (PcBN) composites) may have been suitable materials for use as a cutting insert in a roof drill bit because of their increased wear resistance, but have been difficult to braze. Other materials such as, for example, hard [CVD or PVD] coated cemented carbides have the increased wear resistance to be a suitable material for use as a cutting insert in a roof drill bit, but the residual brazing stresses have restricted the use of these materials as a cutting insert. As a consequence, these materials have not been realistic candidates for use as cutting inserts in a roof drill bit.

In view of the drawbacks associated with brazing the cutting insert into the slot of a roof drill bit, it would be desirable to provide a roof drill bit wherein the cutting insert would be affixed within the slot of the roof drill bit without using a brazing process. Such a roof drill bit would have less of a chance of premature failure due to the presence of residual stresses. Such a roof drill bit would be able to use a wider range of materials for the cutting insert than has been heretofore available.

There comes a point where the cutting insert in the roof drill bit has reached a condition where the cutting action by the bit is no longer sufficient. At this point one of two processes occurs. One process comprises the regrinding of the cutting insert without removing the cutting insert from the roof drill bit. The other process comprises debrazing the cutting insert so as to be able to remove it from the roof drill bit body, and then brazing a new cutting insert to the roof drill bit body. Each process has certain costs associated therewith which add to the overall cost of the drilling operation.

To reduce these additional costs it would be desirable to provide a roof drilling bit which would not require regrinding to place the cutting insert back in condition for cutting. It would also be desirable to provide a roof drilling bit that does not require debrazing/brazing of the cutting insert to replace a worn cutting insert.

SUMMARY

In one form thereof, the invention is a cutting bit which comprises a bit body which has a forward end and a rearward end as well as a seat at the forward end thereof. The bit body also contains a bore intersecting the seat wherein a bore wall defines the bore. A cutting insert is received by the seat wherein the cutting insert presents a side surface facing the bore. There is a wedge which has a generally longitudinal seating surface. The wedge has a support surface opposite to the longitudinal seating surface. The wedge is received within the bore so that the longitudinal seating surface of the wedge contacts the side surface of the cutting insert and for at least a portion of the length of the wedge substantially all of the support surface contacts the bore wall so as to frictionally retain the cutting insert in the seat.

BRIEF DESCRIPTION OF THE DRAWINGS

The following is a brief description of the drawings that form a part of this patent application.

DETAILED DESCRIPTION

Figure 1:
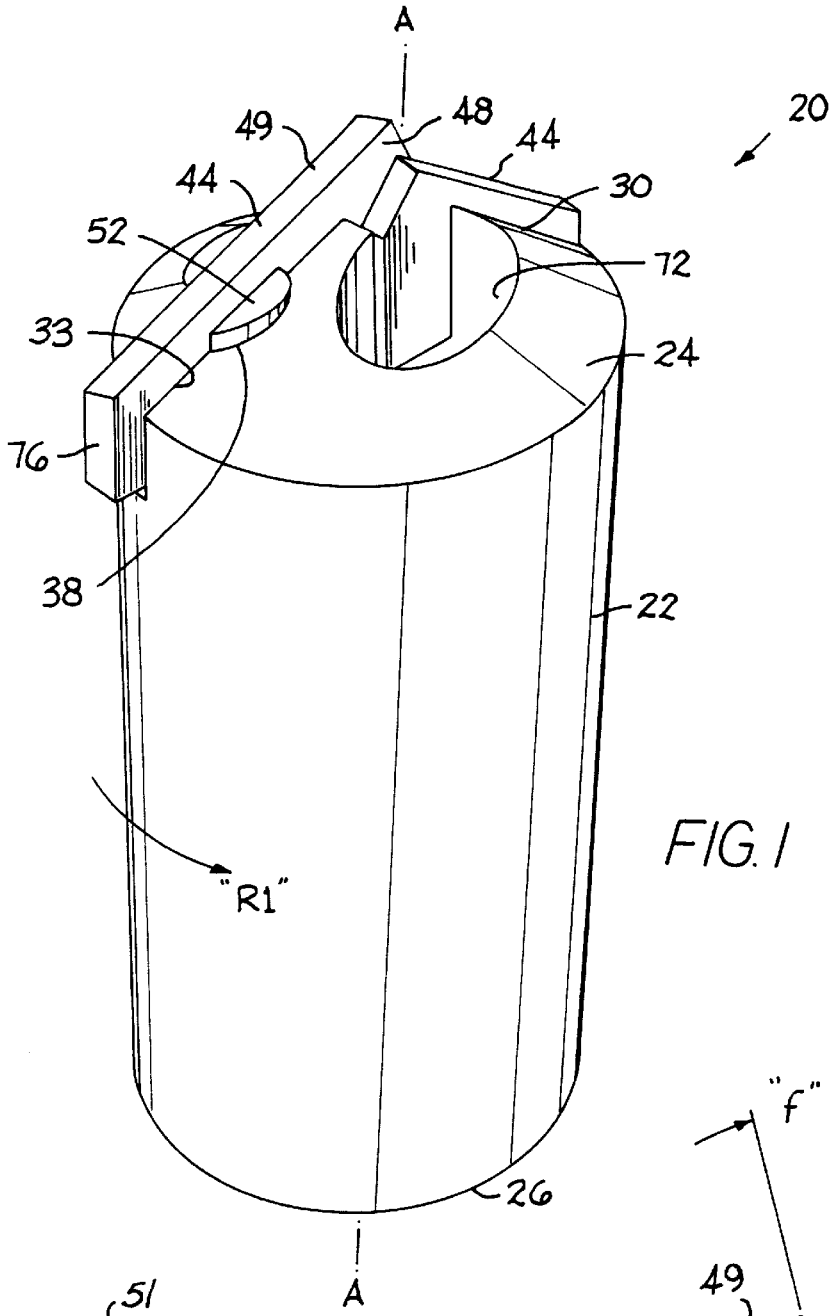
FIG. 1 is an isometric view of a specific embodiment of a roof drill bit.

Referring to the drawings, a rotatable cutting bit (or roof drill bit) 20 has an elongate bit body 22 with an axially forward end 24 and an axially rearward end 26, as well as a central longitudinal axis A—A (see FIG. 1). The direction of rotation of the bit when in use is shown by the arrow "R1". Bit body 22 contains a cavity 28 (see FIGS. 3, 4, and 5) which is defined by a cavity wall 29. Bit body 22 contains a pair of slots 30, 33 at the axially forward end 24 thereof. Slot 30 has opposite generally parallel surfaces 31 and 32 and a bottom surface 39. Surfaces 31 and 32 are generally parallel to the longitudinal axis A—A of the bit body 22. Bottom surface 39 is generally perpendicular to the longitudinal axis A—A of the bit body 22. Slot 33 has opposite generally parallel surfaces 34 and 35, and a bottom surface 40. Surfaces 34 and 35 are generally parallel to the longitudinal axis A—A of the bit body 22. Bottom surface 40 is generally perpendicular to the longitudinal axis A—A of the bit body 22.

Figure 3:
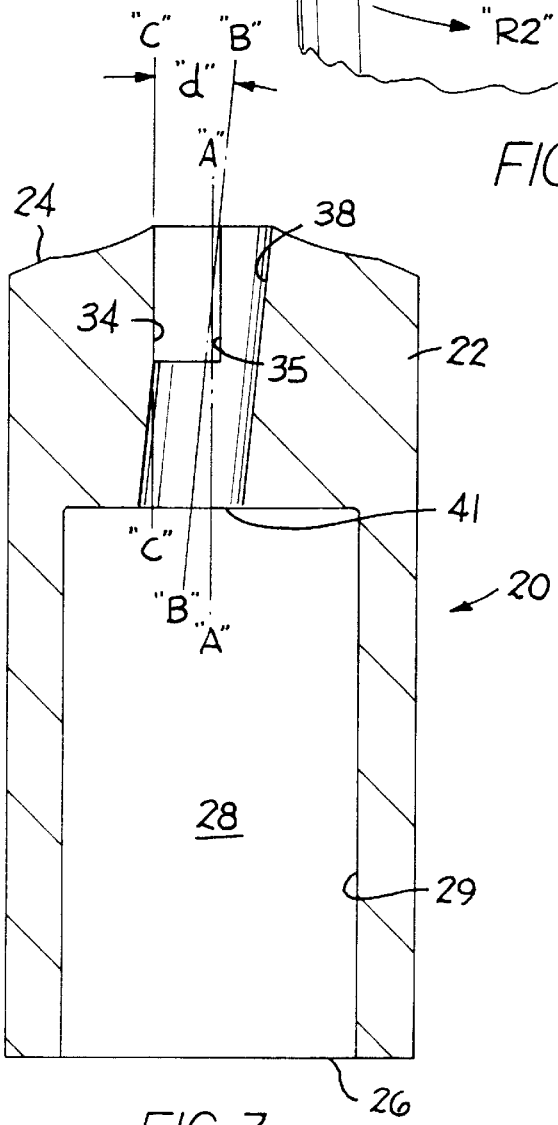
FIG. 3 is a side view of the roof drill bit of FIG. 1 with a portion of the bit body broken away, and with the cutting inserts and wedges removed so as to show the orientation of the bore relative to the slot.

Bit body 22 contains a pair of bores 36 and 38 intersecting the slots 30, 33 respectively, wherein each bore 36, 38 passes through the bottom surface 39, 40 (respectively) of the its respective slot 30, 33 so that each bore 36, 38 is in communication with the cavity 28, as well as in communication with its respective slot 30, 33. As shown in FIG. 3, bore 38 has a rearward end 41 thereof. As also shown in FIG. 3 with respect to bore 38, and which is also applicable to bore 36, bore 38 has its central longitudinal axis B—B disposed relative to a line C—C along the surface of slot surface 34 (if extended axially rearwardly line C—C and axis B—B intersect) at an included bore disposition angle "d" equal to about 5 degrees. It should be appreciated that it is preferable that included bore disposition angle "d" vary between greater than 0 degrees and about 15 degrees. More preferably, included bore disposition angle "d" may vary between about 3 degrees and about 10 degrees. Most preferably, included angle "d" may vary between about 5 degrees and about 7 degrees. It should be appreciated that in this specific embodiment, the opposite surfaces 34 and 35 of the slot 38 are generally parallel to the central longitudinal axis A—A of the bit body 22.

Figure 1B:
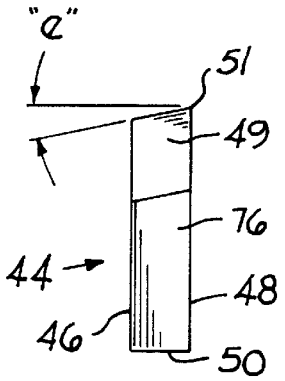
FIG. 1B is an end view of the radially outer end of the cutting insert of FIG. 1A.
Figure 1A:
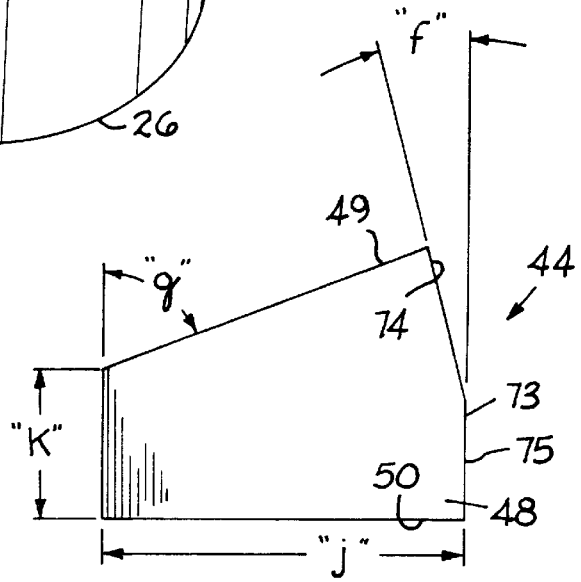
FIG. 1A is a front view of a cutting insert from the roof drill bit of FIG. 1.

A pair of identical cutting inserts 44 are at the axially forward end 24 of the bit body 22 so that each slot (30, 33) contains a cutting insert 44. Each cutting insert 44 has opposite side surfaces 46, 48, a top surface 49, a bottom surface 50, a radially inner edge 73 with an angled portion 74 and a normal portion 75, and a radially outer edge 76. A cutting edge 51 is defined at the junction of the one side surface 48 and the top surface 49. The top surface 49 is relieved from a plane generally perpendicular to the longitudinal axis A—A of the bit body 22 at a relief angle "e" (see FIG. 1B) equal to 20 degrees; however, applicants intend that the relief angle "e" may range between about 5 degrees to about 30 degrees. The angled portion 74 is disposed with respect to the normal portion 75 at an angle "f" equal to 12 degrees. The cutting edge 51 has an angle of disposition "g" with respect to the radially outer edge 76 equal to 70 degrees. The length "j" of the cutting insert 44 is equal to 0.78 inches (19.81 mm) and the height "k" is equal to 0.50 inches (12.7 mm).

Figure 2:
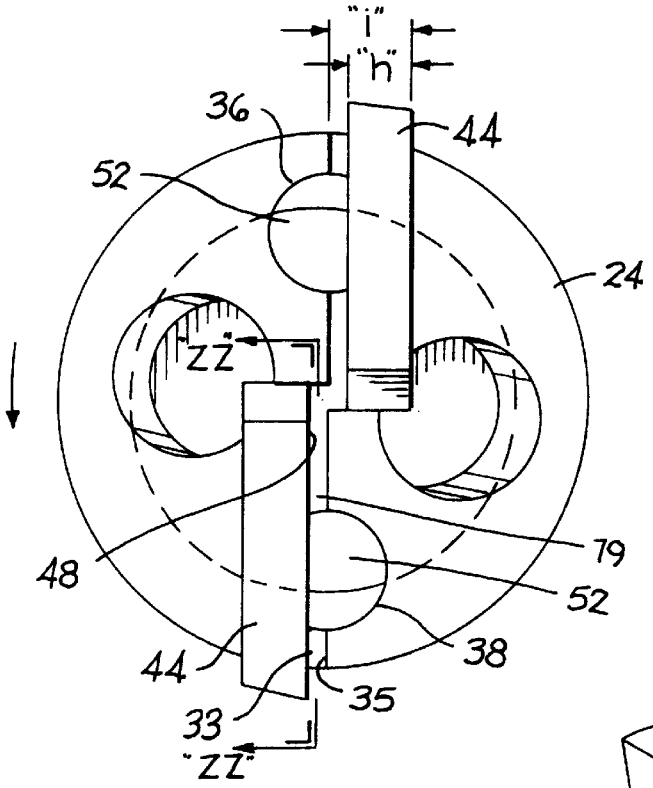
FIG. 2 is a top plan view of the roof drill bit of FIG. 1.

The bottom surface 50 of the cutting insert 44 rests upon the bottom surface (39, 40) of its respective slot (30, 33). Referring to FIG. 2, the thickness "h" of the cutting insert 44, which equals 0.18 inches (4.57 mm), is slightly less than the width "i" of the slot 30 and 33 even though this difference in thickness (or gap) is exaggerated in FIG. 2. In the specific embodiment depicted in FIGS. 1 and 2, the gap is about 0.020 inches (0.508 mm). However, applicants contemplate that the gap may range between about 0.002 inches (0.051 mm) and about 0.030 inches (0.762 mm).

Figure 6:
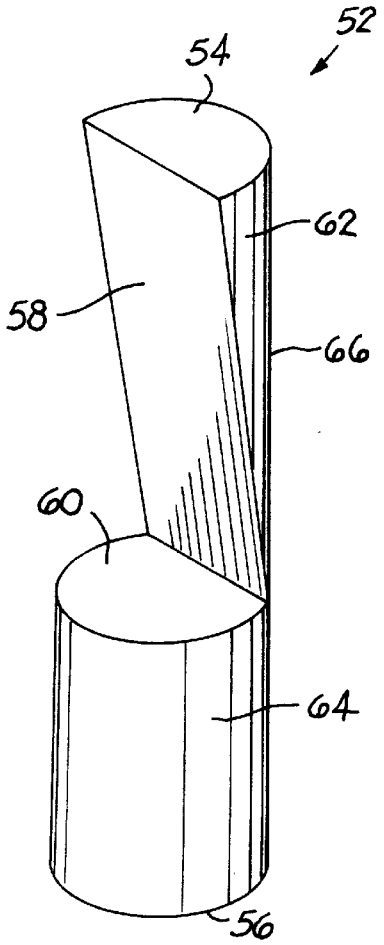
FIG. 6 is an isometric view of the wedge of FIG. 1.
Figure 2A:
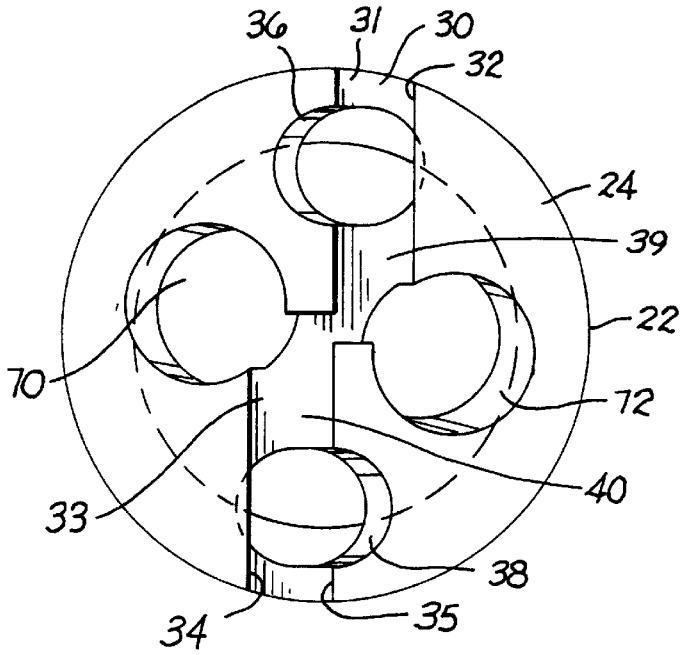
FIG. 2A is a top plan view of the bit body of the roof drill bit of FIG. 1 without the cutting inserts or the resilient wedges being carried by the drill bit body.

Roof drill bit 20 also includes a pair of identical resilient wedges 52 (see FIG. 6) wherein each wedge 52 cooperates with its associated bore, slot, and cutting insert so as to mechanically retain each cutting insert within its respective slot. Each resilient wedge 52 has an axially forward end 54 and an axially rearward end 56. Wedge 52 also presents a longitudinal seating surface 58 and (as an option) a transverse surface 60. The preferred material for the wedge 52 is a steel which has a hardness of less than about 30 Rockwell C ($R_C$) such as, for example, AISI 1045 or AISI 1018 grade steels. However, applicants contemplate that other materials may be suitable for use as the wedge.

Figure 7:
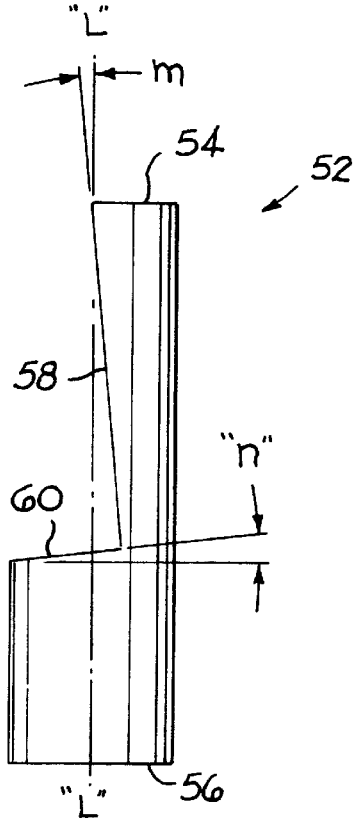
FIG. 7 is a side view of the wedge of FIG. 6.

Referring to FIG. 7, the surface of the longitudinal seating surface 58 is disposed relative to the central longitudinal axis L—L of the wedge 52 at an included wedge disposition angle "m" equal to about 5 degrees. It should be appreciated that it is preferable that included wedge disposition angle "m" vary between greater than 0 degrees and about 10 degrees. More preferably, included wedge disposition angle "m" may vary between about 3 degrees and about 10 degrees. Most preferably, included wedge disposition angle "m" may vary between about 5 degrees and about 7 degrees. Although the transverse surface 60 does not perform any function in regard to the mechanical retention of the cutting insert in the slot (i.e., the transverse surface 60 is spaced apart from the bottom surface 50 of the cutting insert 44), it is pointed out that the surface of the transverse surface 60 is disposed relative to the transverse axis L—L of the wedge at an included angle "n" of about 5 degrees.

The portion of the wedge 52 which is axially forward of the transverse surface 60 is the axially forward portion 62 of the wedge 52. The portion of the wedge 52 which is axially rearward of the transverse surface 60 is the axially rearward portion 64 of the wedge 52. Wedge 52 further has a generally cylindrical surface 66 which is opposite to the longitudinal seating surface 58. Cylindrical surface 66 may be considered to be a support surface when the wedge 52 is in use.

The bit body 22 preferably contains a pair of generally axially oriented passages 70 and 72 at the axially forward end 24 thereof. Passages 70, 72 provide communication between the cavity 28 and the axially forward end 24 of the bit body 22. Debris (and chips) from the drilling operation are evacuated under a vacuum through the passages 70, 72. The evacuation of the debris reduces the temperature at the cutting insert during the drilling operation. Although two passages are illustrated in the specific embodiment, it should be understood that applicants do not intend to limit the scope of the invention to include two passages. Applicants contemplate that depending upon the particular application there may not be a need for any generally axially oriented passage or that there may be any number of such passages in the bit body. Applicants also contemplate that the present roof bit may be used in a wet drilling operation. In a wet drilling operation, the passages 70, 72 would function to provide a pathway for a flow of fluid (e.g., water) to the forward end of the bit body, i.e., fluid would flow through the passages 70, 72. Applicants also contemplate that for a wet drilling operation, the outside surface of the bit body may contain flats, or some other relief in the surface, so as to provide a passage for the fluid and debris to exit from near the cutting inserts.

In use, each one of the wedges 52 functions to mechanically retain through frictional engagement its respective cutting insert 44 within its respective slot (30, 33). The discussion below will focus on the retention of the cutting insert 44 in slot 33; however, it should be appreciated that the discussion is also applicable to the retention of the cutting insert 44 in slot 30.

Figure 4:
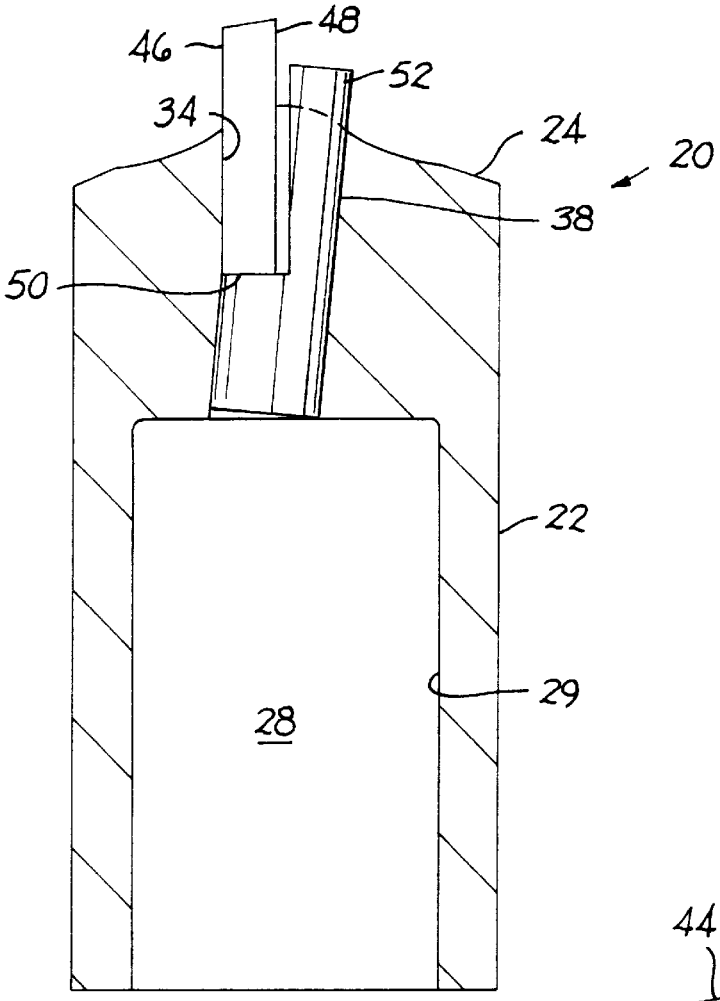
FIG. 4 is a side view of the roof drill bit of FIG. 1 with a portion of the bit body broken away so as to illustrate the cooperation between the cutting insert and the wedge, and wherein the wedge is loosely positioned in the bore and the cutting insert rests in the slot.
Figure 5:
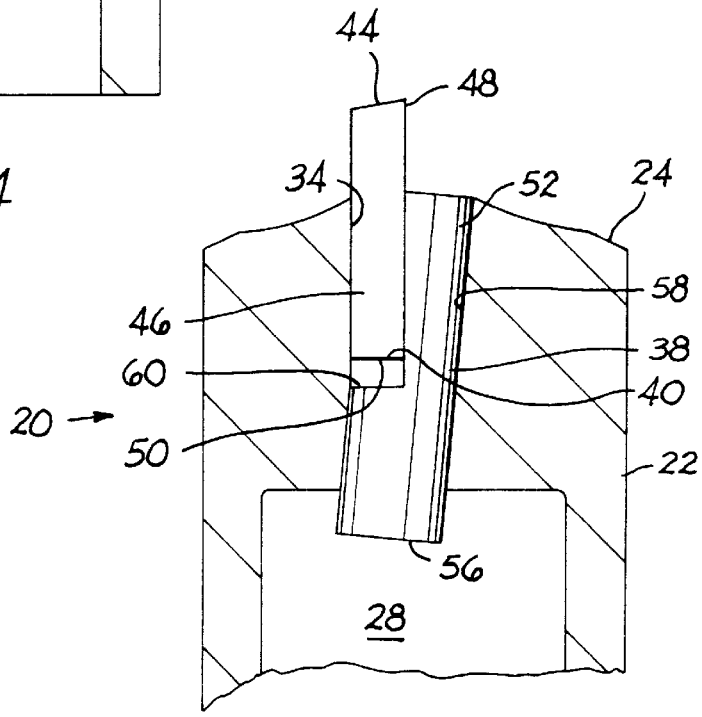
FIG. 5 is a side view like that of FIG. 4, except that the wedge has been pushed into its respective bore so that it frictionally retains the cutting inset in the slot.

Referring to FIGS. 4 and 5, in FIG. 4 the wedge 52 is loosely positioned within its respective bore 38. Cutting insert 44 is also positioned within its slot 33 wherein it rests upon the bottom surface 40 of the slot 33. In order to secure the cutting insert 44 within the slot 33, the wedge 52 is pushed axially rearwardly into its bore 38 using a small press or a hammer and punch or any other suitable means. As the wedge 52 moves axially rearwardly the orientation of the bore (and hence the wedge) relative to the slot (and hence the cutting insert) cause the wedge 52 to move toward the cutting insert 44 so that the longitudinal seating surface 58 of the wedge 52 initially contacts the side surface 48 of the cutting insert 44. Additional movement of the wedge 52 in the axially rearward direction causes the longitudinal seating surface 58 of the wedge 52 to exert additional force upon the side surface 48 of the cutting insert 44 whereby the cutting insert 44 is sandwiched, and thus securely retained, between the surface 34 of the slot 33 and the longitudinal seating surface 58 of the wedge 52. The cylindrical surface 66 also contacts the bore wall so that for at least a portion of the length of the wedge 52 substantially all of the circumference of the cylindrical surface at any point along that length contacts the bore wall. There is slight gap 79 between side surface 48 of the cutting insert 44 and the slot surface 35 of slot 33. The roof drill bit 20 is now in a condition for use.

It should be appreciated that the included bore disposition angle "d" between the longitudinal bore axis B—B and the line C—C is preferably less than the included wedge disposition angle "m" between the longitudinal seating surface 58 of the wedge and the central longitudinal wedge axis L—L. Because of this difference, the point of contact between the longitudinal seating surface and the side surface of the cutting insert 44 will first occur near the top edge (or cutting edge) of the cutting insert 44. Although when the wedge is fully positioned within its bore the longitudinal seating surface will contact a substantial portion of the height of the side surface, the force of this contact will remain greatest near the top edge of the cutting insert 44. It should be appreciated that the included bore disposition angle "d" may be equal or about equal to the included wedge disposition angle "m". The important feature of the wedge is that upon contact with and deformation against the cutting insert there is sufficient frictional engagement of the cutting insert between the wedge and the opposite slot surface so as to secure the cutting insert in the slot.

The extent of the axially rearward movement of the wedge 52 is such so that the axially rearward end 56 thereof may extend into the cavity 28 of the roof drill bit 20. When the roof drill bit 20 is taken out of service after use, it is common practice to remove the cutting inserts from the roof bit body 22 for replacement. Because each wedge preferably extends into the cavity so that the bottom end thereof is accessible through the rearward opening in the cavity, it is relatively easy for the operator using a small press (or a hammer and punch or any other suitable means) to push each wedge in an axially forward direction until the force exerted thereby on its respective cutting insert is small or non-existent. At this point, the operator can then easily remove the cutting insert and wedge from their respective slot and bore. A new cutting insert can then be assembled to the roof bit body as described above.

Figure 8:
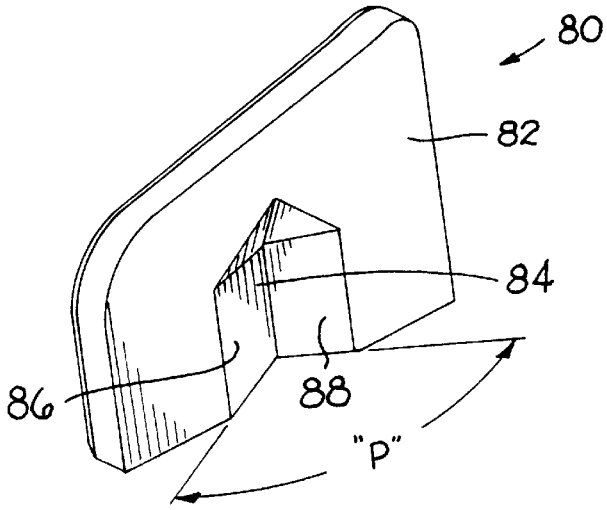
FIG. 8 is an isometric view of a second embodiment of the cutting insert wherein the side surface of the cutting insert contains a groove.
Figure 9:
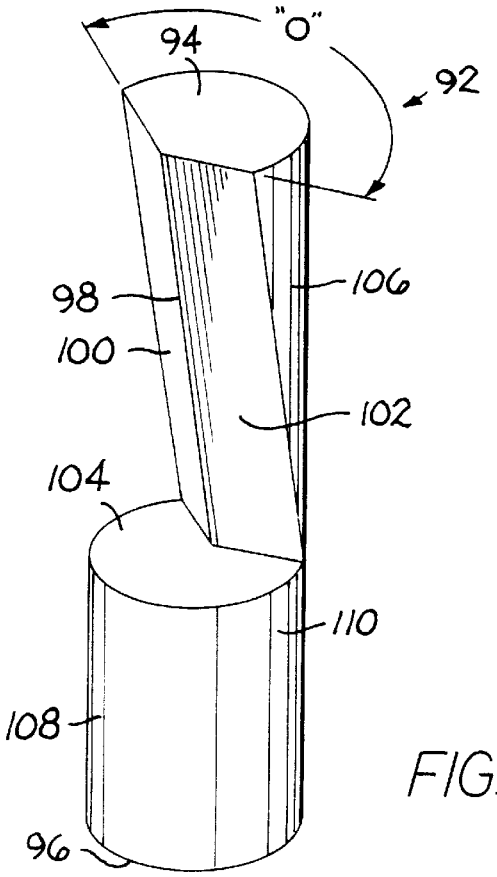
FIG. 9 is an isometric view of a second embodiment of the wedge that is intended to be used with the cutting insert depicted in FIG. 8.

Referring to FIGS. 8 and 9, there is illustrated a second embodiment of the cutting insert 80 which has a side surface 82 which faces the bore of the bit body when the cutting insert 80 is in its respective slot. Side surface 82 contains a groove 84 which has opposite groove surfaces 86 and 88. In such an orientation, the cutting insert 80 would be suitable for use with a cutting bit body like that of FIG. 12. Cutting insert 80 is also designed to be assembled to a roof bit body like that of FIG. 1. Cutting insert 80 is designed to function in cooperation with a second embodiment of the wedge 92 as described below.

Wedge 92 has an axially forward end 94 and an axially rearward end 96. Wedge 92 presents a longitudinal seating surface 98 which has opposite surface portions 100 and 102. The included angle of disposition "o" between surface portions 100 and 102 corresponds to, i.e., is about equal to, the included angle of disposition "p" between the groove surfaces 86 and 88 of the groove 84. Wedge 92 further optionally has a transverse surface 104. The surface portions 100 and 102 of the longitudinal seating surface 98 are each disposed relative to the central longitudinal axis of the wedge 92 at an included angle equal to about 5 degrees so as to present the specific orientation, as well as the preferred ranges of orientation (e.g., greater than 0 degrees to about 10 degrees, about 3 degrees to about 10 degrees, and about 5 degrees to about 7 degrees), like that of the longitudinal seating surface of the wedge 52.

The portion of the wedge 92 which is axially forward of the transverse surface 104 is the axially forward portion 106 of the wedge 92. The portion of the wedge 92 which is axially rearward of the transverse surface 104 is the axially rearward portion 108 of the wedge 92. Wedge 92 further has a generally cylindrical surface 110 which is opposite to the longitudinal seating surface 98.

The second specific embodiment of the cutting insert 80 and the wedge 92 function in a fashion that is like that of the first embodiment of the wedge and cutting insert in that the wedge 92 frictionally retains the cutting insert 80 in its slot, except that the shape of the longitudinal seating surface 98 is such that it registers with the groove 84 in the cutting insert 80. The existence of this registration helps prevent the premature removal of the cutting insert 80 if the wedge 92 should happen to come loose during a drilling operation. This registration also helps position the cutting insert 80 radially in its respective slot. Like for the first embodiment (FIG. 1), when in an assembled condition the bottom end of the wedge 92 may extend into, or be accessible from, the cavity of the roof bit body so as to facilitate the easy removal of the wedge 92 and the cutting insert 80 in a manner like that of the first embodiment.

Figure 10:
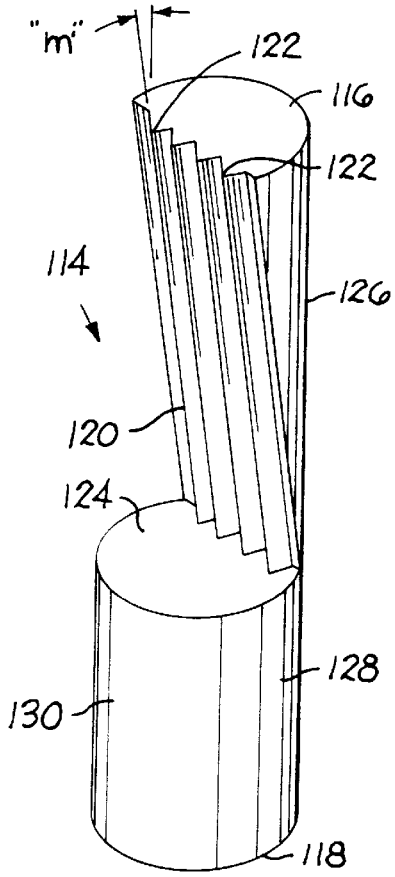
FIG. 10 is an isometric view of a third embodiment of the wedge that cooperates with a cutting insert like that illustrated in FIG. 1, and wherein the wedge presents longitudinal ribs.

Referring to FIG. 10, there is illustrated another specific embodiment of the wedge 114 which is designed to be used with a cutting insert 44 like that of the first embodiment which has a generally planar side surface to be contacted by the wedge. Wedge 114 has an axially forward end 116 and an axially rearward end 118. Wedge 114 presents a longitudinal seating surface 120 which contains a plurality of longitudinal ribs 122. Although ribs 122 are illustrated as being longitudinal, applicants contemplate that the ribs may be transverse or that the longitudinal seating surface may present any one of a number for deformable projections which deform upon initial contact with the cutting insert. Wedge 114 further optionally has a transverse surface 124.

The longitudinal seating surface 120 is disposed relative to the central longitudinal axis of the wedge 114 at an included angle "m'" equal to about 5 degrees. Included angle "m'" is similar to included angle "m" which is the angle of disposition between longitudinal seating surface 58 and central longitudinal axis L—L of wedge 52. Hence, the specific orientation, as well as the ranges of preferred orientations, of the seating surface 120 relative to the central longitudinal axis of the wedge 114 are like those of the longitudinal seating surface 58 relative to the axis L—L of the wedge 52 as shown in FIG. 7.

The portion of the wedge 114 which is axially forward of the transverse surface 124 is the axially forward portion 126 of the wedge 114. The portion of the wedge 114 which is axially rearward of the transverse surface 124 is the axially rearward portion 128 of the wedge 114. Wedge 114 further has a generally cylindrical surface 130 which is opposite to the longitudinal seating surface 120 and to the transverse surface 124.

Wedge 114 functions in cooperation with a bit body and cutting insert like those of the first embodiment in that the wedge 114 frictionally retains the cutting insert in its respective slot. The ribs 122 provide for deformation upon the initial contact of the side surface of the cutting insert by the longitudinal seating surface 120 of the wedge 114. The ribs also provide for enhanced gripping of the side surface of the cutting insert which results in the enhanced mechanical retention of the cutting insert by the wedge 114. Although the specific embodiment of FIG. 10 depicts the ribs as having a longitudinal orientation, applicants contemplate that the ribs may have a transverse (or non-longitudinal) orientation and/or that there may be protrusions rather than ribs on the longitudinal seating surface.

Figure 11:
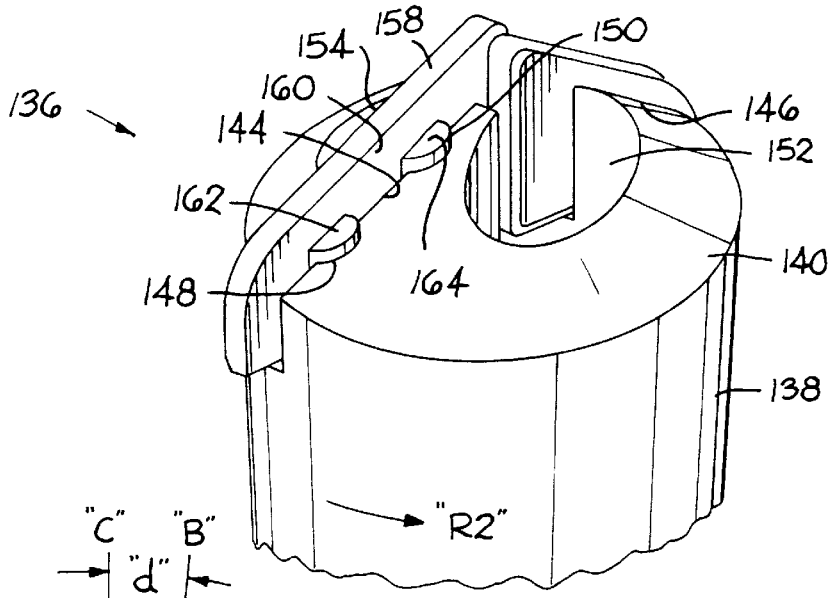
FIG. 11 is an isometric view of a second embodiment of the roof drill bit where two wedges act to frictionally retain each one of the cutting inserts in its respective slot.

Referring to FIG. 11 there is illustrated another embodiment of the roof drill bit generally designated as 136. The direction of rotation of the roof drill bit 136 when in use is shown by arrow "R2". Roof drill bit 136 has a bit body 138 with an axially forward end 140 and an axially rearward end (not illustrated). The bit body 138 contains a pair of slots 144, 146 at the axially forward end 140 thereof. The bit body 138 contains a pair of bores which cooperate with each one of the slots even though only one pair of bores 148, 150 is illustrated in FIG. 11 so as to cooperate with slot 144. Bores 148 and 150 are in communication with slot 144 and the cavity of the bit. Bit body 138 further contains a pair of passages 152 and 154.

The roof drill bit 136 further includes a pair of cutting inserts 158 wherein each one of the slots (144, 146) carries a cutting insert 158. Cutting insert 158 has a side surface 160 as illustrated in FIG. 11. The orientation of the bores (148, 150) is like that of bore 38 in the first embodiment. A resilient wedge 162 is contained within bore 148 and another resilient wedge 164 is contained within bore 150. The resilient wedges 162, 164 may be of the same structure as the wedge 52 of the first embodiment.

In use, the wedges 162, 164 function to secure the cutting insert 158 in its respective slot 144, 146 in a way that is the same as that for the first embodiment. The difference between this embodiment and the first embodiment is in the presence of two wedges (and thus two bores) which function to retain each cutting insert in contrast to one wedge and one bore. It should be appreciated that other embodiments of the wedges and the cutting insert may be used in conjunction with the second embodiment of the bit body.

Figure 12:
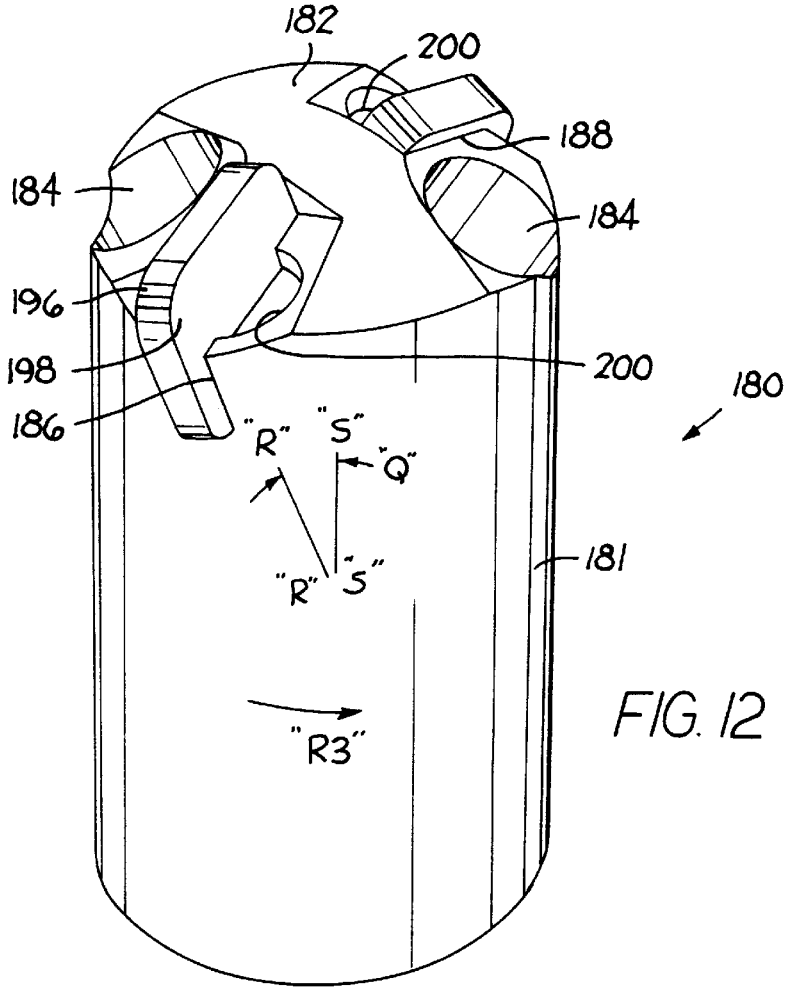
FIG. 12 is an isometric view of a third embodiment of the roof drill bit wherein the cutting inserts are disposed at a negative rake angle.
Figure 13:
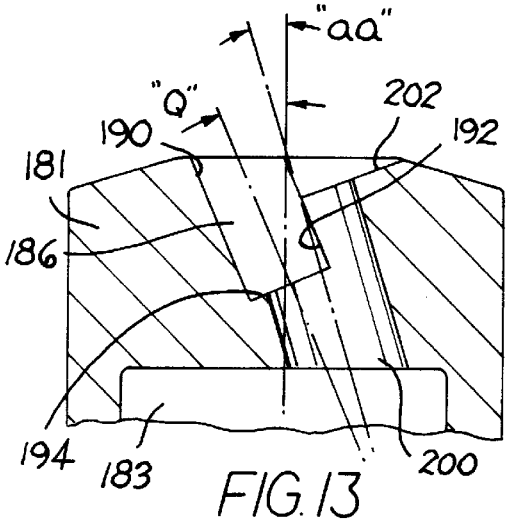
FIG. 13 is a cross-sectional view of the forward end of the bit body of the embodiment of FIG. 12 showing the orientation of the bore with respect to the slot so as to illustrate the disposition angle "aa" of the compound angled bore.
Figure 14:
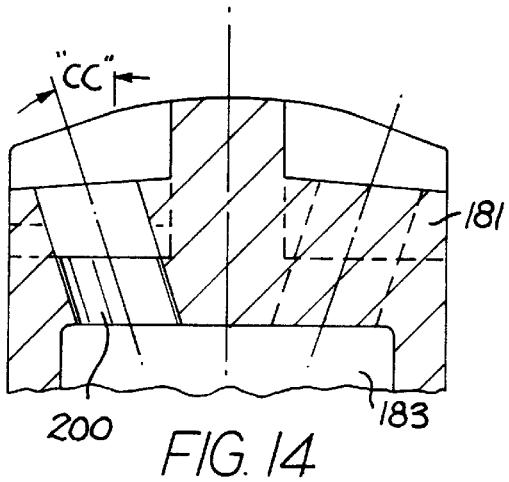
FIG. 14 is a cross-sectional view of the forward end of the bit body of the embodiment of FIG. 12 showing the orientation of the bore so as to illustrate the disposition angle "cc" of the compound angled bore.
Figure 15:
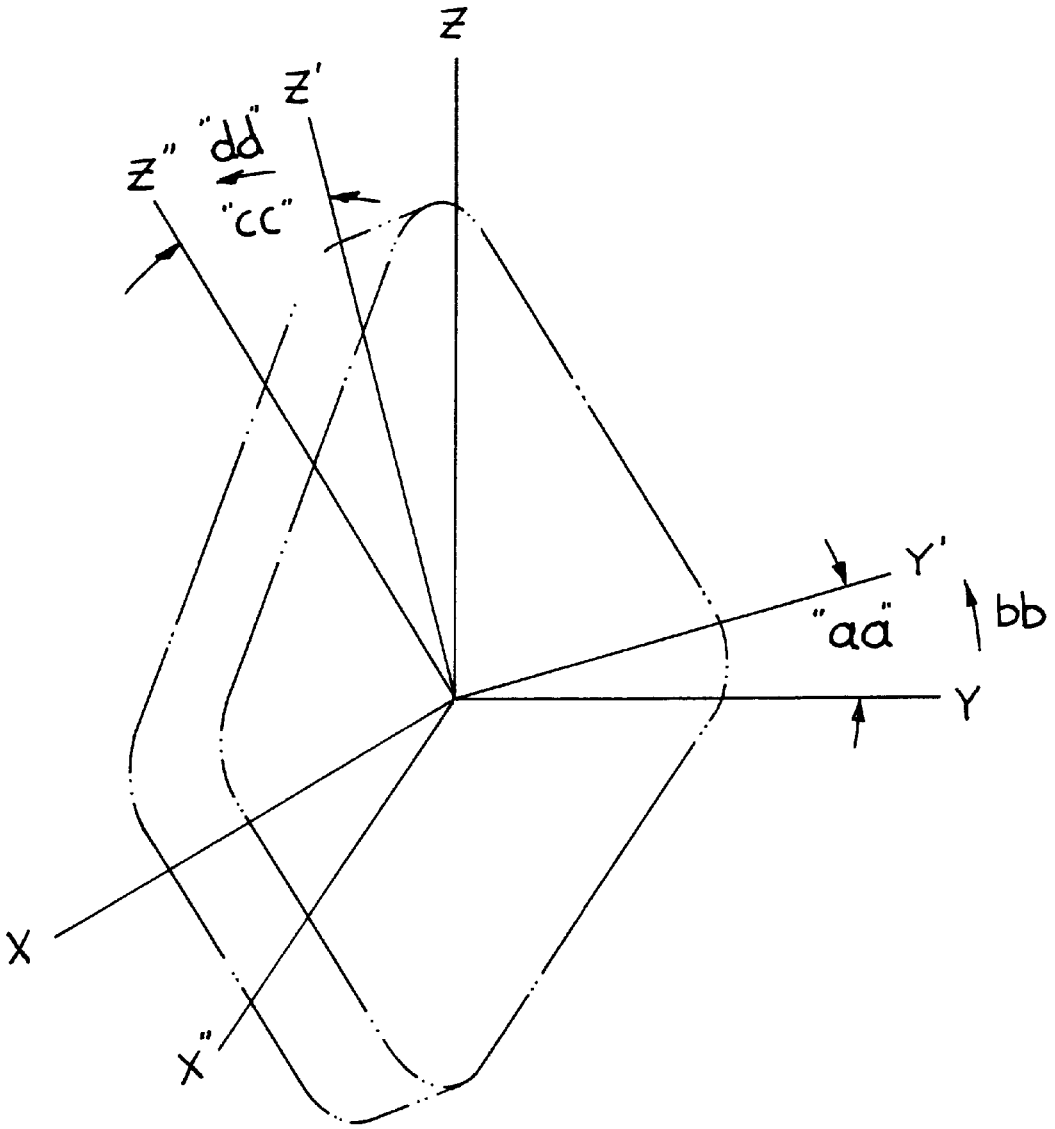
FIG. 15 is a schematic view of the coordinate axis for the compound angled bore of FIG. 12.

Referring to FIGS. 12 through 14, there is shown another specific embodiment of the roof drill bit, generally designated as 180. The direction of rotation of roof drill bit 180 is shown by arrow "R3". Roof drill bit 180 has a bit body 181. At the forward end 182 of the bit body 181 is a pair of peripheral passages 184 that communicates with a cavity 183 defined by the bit body 181. At the forward end 182 of the bit body 181 there are also a pair of slots 186, 188.

The description of slot 186 will suffice for the description of slot 188. Slot 186 has opposite slot surfaces 190, 192, and a bottom surface 194. Slot surfaces 190, 192 are generally parallel to each other, and are generally perpendicular to the bottom surface 194 of the slot 186. Each slot 186, 188 contains a cutting insert 196, which is structurally the same as the cutting insert 158 wherein cutting insert 196 includes a side surface 198. The slot 186 has an orientation so as to position a cutting insert therein at a negative rake angle "Q", i.e., the included angle between a line R—R parallel to the face of the cutting insert and a line S—S parallel to the central longitudinal axis of the bit body 181 wherein lines S—S and R—R intersect. Angle "Q" is negative when line R—R trails line S—S with respect to the direction of rotation "R3" as shown in FIG. 12. In the specific embodiment of FIGS. 12 through 14, angle "Q" equals about 20 degrees, but applicants contemplate that angle "Q" can range between about 0 degrees to about 30 degrees.

The bit body 181 also contains at its axially forward end 182 a pair of bores 200 wherein each bore 200 intersects with its respective slot 186, 188. The bit body 181 contains a recessed portion 202 at the forward end of the bore 200.

Each bore 200 is a compound angled bore. In the context of the specific embodiment of FIGS. 12 through 14, a compound angled bore is a straight bore having an orientation which is at an angle with respect to each of the primary axes x-y-z (see FIG. 15). Applicants also contemplate that the compound angled bore may also have an orientation which is at an angle with respect to only two axes of the three primary axes x-y-z while being coincident or parallel to the third axis. Referring to FIGS. 12 through 15, bore 200 has an orientation such that it is disposed along axis z" of the coordinate system depicted in FIG. 15. To arrive at axis z", a coordinate system of x-y-z wherein the origin is centered on the face 198 of the cutting insert 196 is positioned so that axis z is parallel to the center line of the bit body. Two rotations are needed to establish the compound angle of the bore 200. The first rotation of the coordinate system is to rotate the system about the x axis angle "aa" in a direction "bb" as viewed in FIG. 15 so as to form a coordinate system with axes x-y'-z'. The second rotation is to rotate the coordinate system x-y'-z' about the y' axis an angle "cc" in the direction "dd" as viewed in FIG. 15 to form a coordinate system of x'-y'-z". The axis of the bore 200 lies along axis z". The magnitude of the angle "cc" of the second rotation should be sufficient so that the bore 200 communicates (or intersects) the cavity in the bit body. For the embodiment of FIG. 12, the preferred angle "aa" is 23.5 degrees and the preferred angle "cc" is 20 degrees.

The roof drill bit 180 also contains a wedge 206 which has a construction like the wedge 52. The function of the wedge 206 is like that of wedge 52 in that as it is moved axially rearwardly, the longitudinal seating surface contacts and deforms against the side surface 198 of the cutting insert 196 so as to sandwich the cutting insert between the longitudinal seating surface and the slot wall 190. The cutting insert 196 is thus securely retained in the slot. The bottom end of the wedge may extend into, or be near, the cavity so as to facilitate the removal of the wedge. As shown in FIG. 12, the top end of the wedge extends into the bore to such an extent that it is recessed below the forward end of the bit body. One preferred type of cutting insert is a polycrystalline diamond composite cutting insert.

Figure 16:
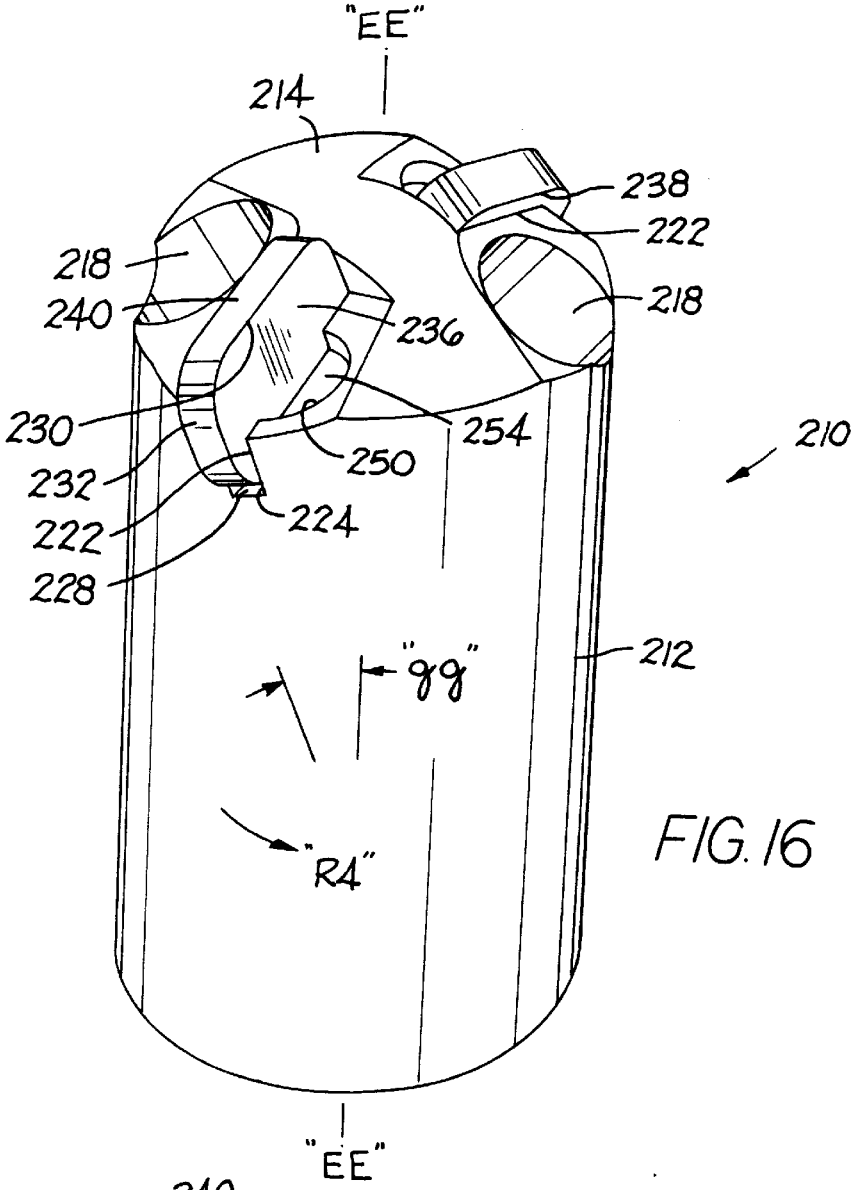
FIG. 16 is an isometric view of another specific embodiment of the invention.
Figure 17:
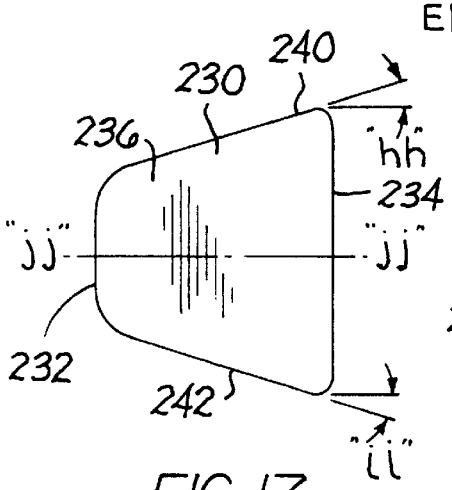
FIG. 17 is a side view of one of the cutting inserts illustrated in the embodiment of FIG. 16.
Figure 18:
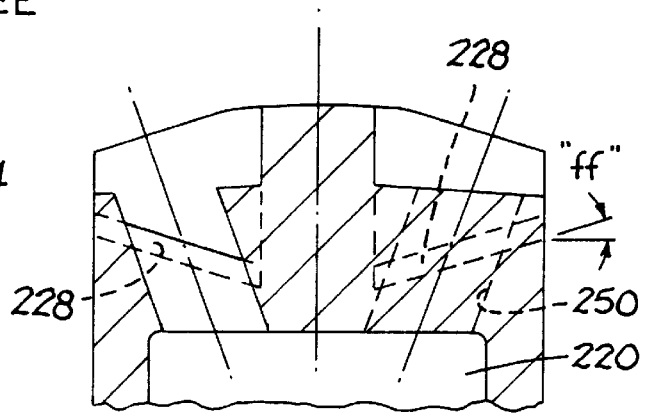
FIG. 18 is a cross-sectional view of the axially forward portion of the drill bit body.

Referring to FIGS. 16 through 18 there is illustrated another embodiment of the roof drill bit generally designated as 210. The roof drill bit 210 rotates in the direction of arrow "R4". Roof drill bit 210 has a bit body 212 with a forward end 214 and a rearward end 216. The forward end 214 of the bit body 212 contains a pair of passages 218 which communicate with a cavity 220 (see FIG. 18) in the bit body 212.

The forward end 214 of the bit body 212 also contains a pair of slots 222 wherein each slot 222 has opposite side surfaces 224 and a bottom surface 228. The bottom surface 228 is disposed with respect to a plane perpendicular to the central longitudinal axis EE—EE of the bit body 212 at an included angle of "ff" wherein the angle "ff" is about 12 degrees.

The roof drill bit 210 further includes a cutting insert 230 wherein each slot 222 receives an indexable cutting insert 230. Each cutting insert 230 is disposed at a negative rake angle "gg" along the lines of the cutting insert of the roof drill bit depicted in FIG. 12.

Cutting insert 230 has opposite ends 232, 234 wherein end 232 is of a lesser dimension and end 234 is of a greater dimension. Cutting insert 230 also has opposite side surfaces 236, 238, a top surface 240, and a bottom surface 242. The top surface 240 is disposed at an included angle "hh" with respect to a line perpendicular to the one opposite end 232 wherein angle "hh" preferably equals about 17 degrees. The bottom surface 242 is disposed at an included angle "ii" with respect to a line perpendicular to the one opposite end 232 wherein angle "ii" preferably equals about 17 degrees.

The slot 222 receives the cutting insert 230 so that the bottom surface 242 thereof rests on the bottom surface 228 of the slot 222. The roof drill bit 210 also includes a pair of bores 250 at the forward end thereof wherein each bore 250 intersects its corresponding slot. Each bore 250 is a compound angled bore along the lines of bore 200 in FIG. 12. Bore 250 also communicates with the cavity 220 in the bit body 212.

The roof drill bit 210 further includes a pair of wedges 254 wherein each bore 250 receives a wedge 254. The wedge 254 presents a structure like that of wedge 206. The operation of wedge 254 relative to cutting insert 230 is like that of wedge 206 with respect to the cutting insert 196 of the roof drill bit 180 illustrated in FIG. 12.

In regard to the indexability of the cutting insert 230, once the cutting insert 230 has become worn, the wedge 254 is removed and the cutting insert 230 rotated about its jj—jj axis (see FIG. 17) 180 degrees and positioned back into the slot. The wedge 254 is then positioned so as to retain the cutting insert in the slot. When in this position, the bottom surface is exposed and the top surface rests against the bottom surface of the slot. The direction of rotation for the roof drill bit 210 is indicated by the arrow "R4".

Referring to FIGS. 19A and 19B, FIGS. 20A and 20B, FIGS. 21A and 21B, and FIGS. 22A and 22B, there are depicted four additional specific embodiments of the cutting bit. The views of FIGS. 19A through 22B are taken from the reference line "zz"—"zz" depicted in FIG. 2. In each one of these four embodiments, the bit body is essentially the same as certain other specific embodiments, such as, for example, the specific embodiments of the bit bodies depicted in FIGS. 1 and 12 hereof. As will become apparent from the description below, however, the differences between these embodiments and those of FIGS. 1 and 12 are in the structure of the bottom surface of the cutting insert and the bottom surface of the slot which receives the cutting insert.

Figure 19A:
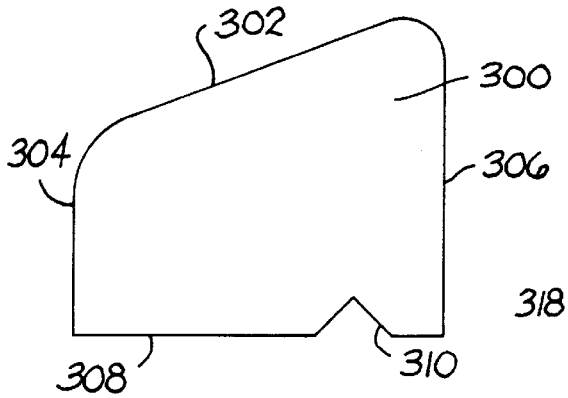
FIG. 19A is a side view of another embodiment of the cutting insert wherein there is a V-shaped notch in the bottom surface thereof taken from the view point like that of reference line "zz"—"zz" in FIG. 2.
Figure 19B:
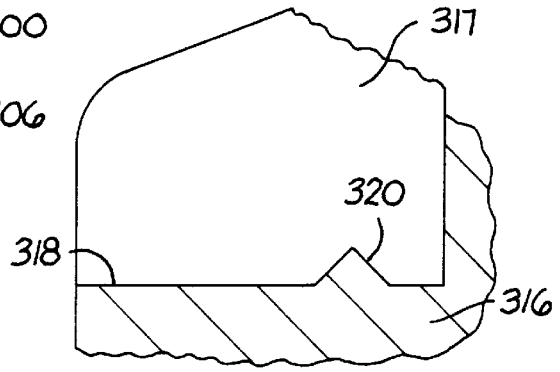
FIG. 19B is a partial cross-sectional view of a portion of the drill bit body showing a V-shaped projection projecting from the bottom surface of the slot taken from the view point like that of reference line "zz"—"zz" in FIG. 2.

FIG. 19A illustrates cutting insert 300 which has a top surface 302, a radially outward side surface 304, a radially inward side surface 306, and a bottom surface 308. A V-shaped notch 310 is contained in bottom surface 308. Referring to FIG. 19B, there is illustrated a cross-section of a portion of the bit body 316 including the slot (or seat) 317 which has a bottom surface 318. A V-shaped projection 320 projects from the bottom surface 318. The configurations of the V-shaped notch 310 and the V-shaped projection 320 are complementary.

When the cutting insert 300 is received within the slot 317, the V-shaped projection 320 is received within the V-shaped notch 310 so that the cutting insert 310 is then correctly oriented with respect to the bit body 316. Furthermore, the registration of the projection 320 in the notch 310 helps secure the cutting insert 300 in the slot during operation of the cutting bit in that this registration provides mechanical resistance against radially outward movement of the cutting insert.

Figure 20A:
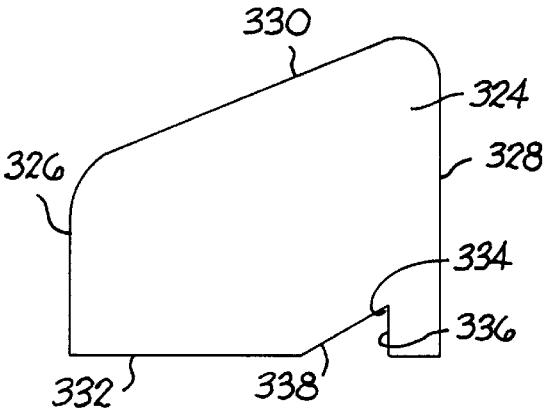
FIG. 20A is a side view of another embodiment of the cutting insert wherein there is a saw tooth shaped notch in the bottom surface thereof taken from the view point like that of reference line "zz"—"zz" in FIG. 2.
Figure 20B:
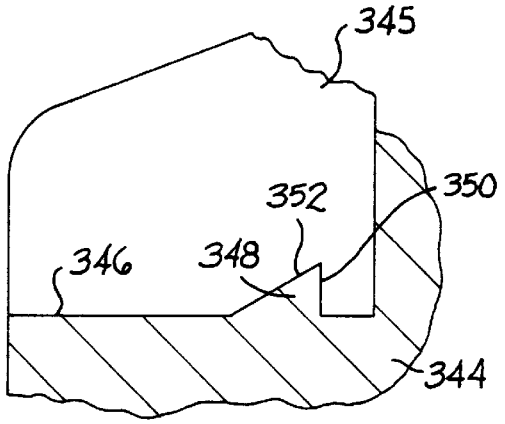
FIG. 20B is a partial cross-sectional view of a portion of the drill bit body showing a saw tooth shaped projection projecting from the bottom surface of the slot taken from the view point like that of reference line "zz"—"zz" in FIG. 2.

FIG. 20A illustrates cutting insert 324 which has a radially outward side surface 326, a radially inward side surface 328, a top surface 330, and a bottom surface 332. A saw tooth shaped notch 334 is contained in bottom surface 332. The notch 334 has a generally vertical surface 336 (which is generally perpendicular to the bottom surface 332 of the cutting insert) and an inclined surface 338. Referring to FIG. 20B, there is illustrated a cross-section of a portion of the bit body 344 including the slot (or seat) 345 which has a bottom surface 346. A saw tooth shaped projection 348 projects from the bottom surface 346. The saw tooth shaped projection 348 has a surface 350 which is generally perpendicular to the bottom surface 346 of the slot 345 and an inclined surface 352. The configurations of the saw tooth shaped notch 334 and the saw tooth shaped projection 348 are complementary.

When the cutting insert 324 is received within the slot 345, the saw tooth shaped projection 348 is received within the saw tooth shaped notch 334 so that the cutting insert 324 is then correctly oriented with respect to the bit body 344. Furthermore, the registration of the projection 348 in the notch 334 helps secure the cutting insert 324 in the slot during operation of the cutting bit in that this registration, and especially the interaction between the vertical surface 336 of the notch and the vertical surface 350 of the projection, provides mechanical resistance against radially outward movement of the cutting insert.

Figure 21A:
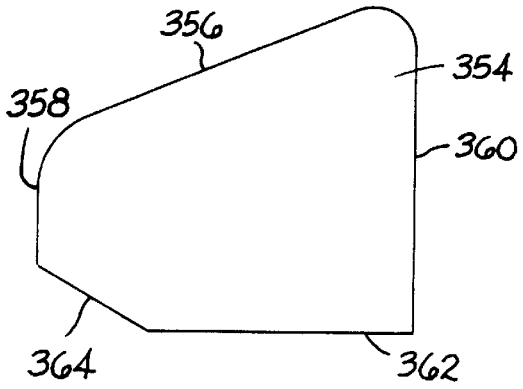
FIG. 21A is a side view of another embodiment of the cutting insert wherein there is a notch at the radially outward bottom corner of the cutting insert taken from the view point like that of reference line "zz"—"zz" in FIG. 2.
Figure 21B:
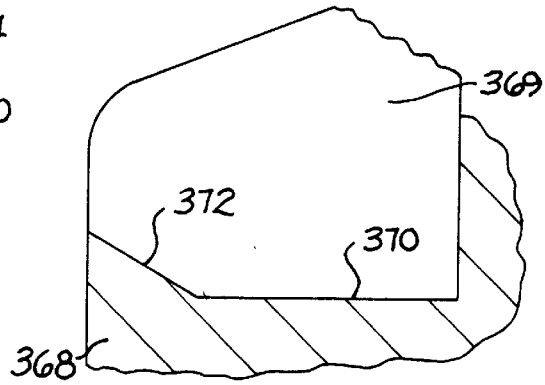
FIG. 21B is a partial cross-sectional view of a portion of the drill bit body showing a ramp surface at the radially outward portion of the bottom surface of the slot taken from the view point like that of reference line "zz"—"zz" in FIG. 2.

Referring to FIG. 21A, there is illustrated another embodiment of a cutting insert 354 which has a top surface 356, a radially outward side surface 358, a radially inward side surface 360, and a bottom surface 362. There is a notch 364 in the bottom surface 362 of the cutting insert 354 adjacent the radially outward bottom corner thereof. Referring to FIG. 21B, there is illustrated a cross-section of a portion of the bit body 368 including the slot (or seat) 369 which has a bottom surface 370. The bottom surface 370 includes a ramp portion 372 adjacent the radially outward end thereof. The configuration of the ramp 372 and the notch 364 are the same so that when the cutting insert 354 is received within the slot 369, the notch 364 and the ramp 372 register so that the cutting insert 354 has a correct orientation with respect to the bit body. In addition, this registration helps retain the cutting insert 354 in the bit body 368 during operation in that this registration provides mechanical resistance against radially outward movement of the cutting insert.

Figure 22A:
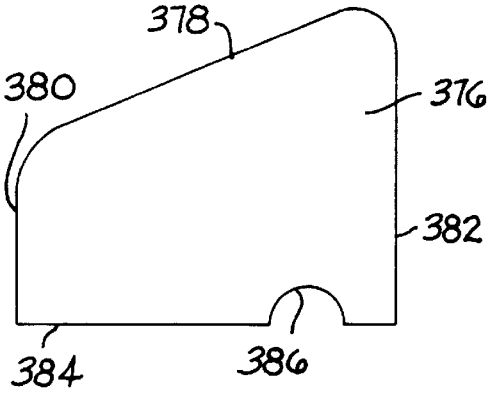
FIG. 22A is a side view of another embodiment of the cutting insert wherein there is a semi-circular notch in the bottom surface thereof taken from the view point like that of reference line "zz"—"zz" in FIG. 2.
Figure 22B:
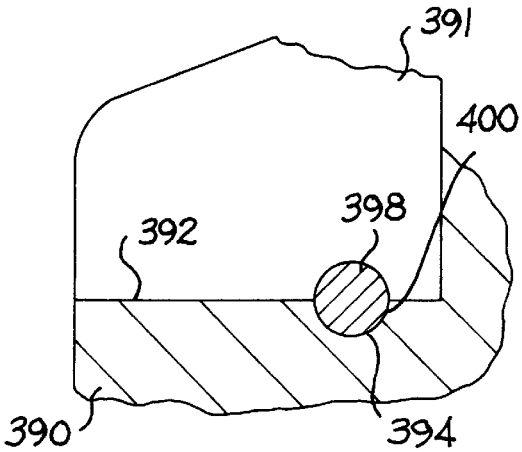
FIG. 22B is a partial cross-sectional view of a portion of the drill bit body showing a semi-circular notch in the bottom surface of the slot and a pin received within the notch taken from the view point like that of reference line "zz"—"zz" in FIG. 2.

Referring to FIG. 22A, there is shown another embodiment of a cutting insert 376 which has a top surface 378, a radially outward side surface 380, a radially inward side surface 382, and a bottom surface 384. The bottom surface 384 contains a semi-circular notch 386. Referring to FIG. 22B, there is illustrated a cross-section of a portion of the bit body 390 including the slot (or seat) 391 which has a bottom surface 392. The bottom surface 392 contains a semi-circular notch 394 therein. A pin 398 is received within a transverse bore 400 which passes through the bit body so as to communicate with the slot 391.

When the cutting insert 376 is received within the slot 391, the semi-circular notch 386 receives the upper portion of the pin 398. When the pin 398 is thus received within the volume defined between the semi-circular notches 386 and 394, the cutting insert 376 is correctly oriented with respect to the bit body 390. In addition, the registration of the pin 398 in the notches 386 and 394 helps retain the cutting insert 376 in the slot 391 during operation of the cutting bit in that this registration provides mechanical resistance against radially outward movement of the cutting insert.

As described above, each one of the above four embodiments of the cutting insert contains a notch in the bottom surface thereof. While the notch provides a registration feature that is somewhat similar to that provided by the groove in the side surface of the cutting insert (see the embodiment of FIG. 8), it has an inherent manufacturing advantage. By providing a notch in the bottom surface of the cutting insert, one may use laser or EDM cutting techniques to form the notch at the same time the periphery of the cutting insert is being cut. Cutting the periphery and the notch in the same operation improves the manufacturing efficiencies as compared to grinding a groove in the side surface of the cutting insert after the periphery of the cutting insert has been cut. Furthermore, for some materials it is easier to cut the notch in the periphery than grind in a groove in the side surface of the cutting insert. In addition, the projection in the bottom surface of the slot for the specific embodiments of FIGS. 19B, 20B and 21B, and the notch in the bottom surface of the slot for the specific embodiment of FIG. 22B, can be made during the casting process thereby eliminating any post-casting manufacturing step to form the projection or the notch in the bottom surface of the slot in the bit body.

Although not illustrated in the drawings, applicants contemplate that the roof drill bit may be attached to a drill steel by means of a chuck such as illustrated and disclosed in U.S. Pat. No. 5,400,861 to Sheirer, or that the roof drill bit may be directly connected to a drill steel.

The performance of two identical specific embodiments of the invention (Invention Nos. 1 and 2 in Table I), which was structured like the specific embodiment of FIG. 1 (the bit was a 1⅜ths inch bit with cutting inserts made of cobalt cemented tungsten carbide having the following composition and physical properties: cobalt content equal to 6.2 weight percent with the balance tungsten carbide, a coercive force ($H_C$) of 115 oersteds, and a hardness of 89.7 Rockwell A), was compared against the performance of four identical commercial roof drill bits (Comparative Nos. 1–4 in Table I) made by Kennametal Inc. of Latrobe, Penn. USA under the model KCV4-1-⅜th inch with a cutting insert that was made of the same material as the cutting insert of Invention Nos. 1 and 2 (see Kennametal Mining Products Catalog A96-55 (15)H6 at page 23). The tests were conducted in a granite substrate. Table I below sets forth the results.

TABLE I

Test Results for Drilling in Granite

| Sample | Rotational Speed (RPM) | Hole Depth (inches) | Feed Rate (inches/ second) | Thrust (pounds) | Torque (inch-pounds) |
|---|---|---|---|---|---|
| Invention 1 | 395 | 14.98 | 0.276 | 4260 | 2275 |
| Invention 2 | 403 | 12.97 | 0.344 | 4338 | 1929 |

TABLE I-continued

Test Results for Drilling in Granite

| Sample | Rotational Speed (RPM) | Hole Depth (inches) | Feed Rate (inches/second) | Thrust (pounds) | Torque (inch-pounds) |
|---|---|---|---|---|---|
| Comparative 1 | 403 | 9.71 | 0.301 | 4414 | 2240 |
| Comparative 2 | 396 | 10.21 | 0.247 | 4388 | 2025 |
| Comparative 3 | 396 | 10.92 | 0.246 | 4253 | 2165 |
| Comparative 4 | 396 | 7.44 | 0.216 | 4314 | 1713 |

The rotational speed was measured in revolutions per minute (RPM). The hole depth was measured in inches and was the depth of the hole at the point when the cutting insert became worn out. The feed rate, the thrust, and the torque reflect the other drilling parameters of the testing.

A review of the test results shows that the specific embodiments of the invention drilled to a significantly greater depth than did the comparative samples of the roof drill bits. In this regard, the average hole depth of the comparative examples was 9.57 inches. While the average hole depth of the inventive samples was 13.98 inches. This is an improvement by the invention over the commercial roof drill bit of about forty-six (46) percent.

Applicants contemplate using other compositions of cobalt cemented carbide wherein these compositions include one composition comprising 6.0 weight percent cobalt with the balance being tungsten carbide, and having a coercive force ($H_C$) equal to 350 oersteds and a hardness equal to 93.3 Rockwell A. These compositions also include another composition comprising 5.7 weight percent cobalt with the balance being tungsten carbide, and a coercive force ($H_C$) equal to 265 oersteds and a hardness equal to 92.7 Rockwell A.

Furthermore, applicants contemplate using cobalt cemented tungsten carbide compositions wherein the hardness is greater than or equal to 90.5 ($R_A$) Rockwell A or using cobalt cemented tungsten carbide compositions wherein the hardness is greater than or equal to 91 ($R_A$) Rockwell A. In addition, other compositions which applicants contemplate using a cobalt cemented tungsten carbide composition having a coercive force ($H_C$) greater than or equal to 160 oersteds, and a cobalt cemented tungsten carbide composition having a coercive force ($H_C$) greater than or equal to 180 oersteds. It should also be appreciated that applicants contemplate using one or more of the following materials for the cutting insert: ceramics, binderless tungsten carbide, polycrystalline diamond composites with metallic binder (e.g., cobalt), polycrystalline diamond composites with ceramic binder (e.g., silicon nitride), and hard coated cemented carbides.

The specific embodiments depict the bores which receive the wedges as opening at the axially forward surface of the bit body. In the alternative, applicants contemplate that the bores which receive the wedges may present an opening in the side surface of the bit body rather than in the axially forward end. These alternative bores have a generally radial orientation with respect to the central longitudinal axis of the bit body.

The patents and other documents identified herein are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A cutting insert for use in connection with a rotatable cutting bit for engaging earth strata and the cutting bit having a bit body wherein the bit body has a seat with a bottom surface a radially inward end and a radially outward end and containing a projection at the radially inward end thereof and wherein the seat carries the cutting insert, the bit body having a bore which intersects the seat and carries a wedge, the cutting insert comprising:

a cutting insert body having a bottom surface with a radially inward end and a radially outward end and the bottom surface containing an insert notch at the radially inward end thereof;

wherein the notch in the bottom invert surface is generally saw tooth shaped.

2. The cutting insert of claim 1 further comprising:

a top surface having a cutting edge; and a radially inward side surface; and a radially outward side surface.

3. The cutting insert of claim 2 further comprising:

two planar side surfaces extending between said radially inward side surface and said radially outward side surface.

4. The cutting insert of claim 1 further comprising:

two planar side surfaces.

5. A cutting insert for use in connection with a rotatable cutting bottom engaging earth strata and the cutting bit having a bit body wherein the bit body has a seat with a bottom surface a radially inward end and a radially outward end and containing a projection at the radially inward end thereof and wherein the seat carries the cutting insert, the bit body having a bore which intersects the seat and carries a wedge, the cutting insert comprising:

a cutting insert body having a bottom surface with a radially inward end and a radially outward end and the bottom surface containing an insert notch at the radially inward end thereof;

wherein the notch in the bottom insert surface having one surface which is generally perpendicular to the bottom insert surface.

6. The cutting insert of claim 5 further comprising:

a top surface having cutting edge; and a radially inward side surface; and a radially outward side surface.

7. The cutting insert of claim 6 further comprising:

two planar side surface extending between said radially inward side surface and said radially outward side surface.

8. The cutting insert of claim 5 further comprising:

two planar side surfaces.

* * * * *